US005926877A

United States Patent [19]

Lin

[11] Patent Number: 5,926,877

[45] Date of Patent: Jul. 27, 1999

[54] ADJUSTABLE SUPPORTING TABLE

[76] Inventor: Joe Lin, No. 2, Lane 72, Section 2, Chung Shan N. Road, Taipei, Taiwan

[21] Appl. No.: 08/956,430

[22] Filed: Oct. 23, 1997

[51] Int. Cl.[6] ..... A47B 7/02

[52] U.S. Cl. ..... 5/618; 5/616; 5/617; 297/330; 297/362.11

[58] Field of Search ..... 5/618, 613, 616, 5/617; 297/330, 362.11

[56] References Cited

U.S. PATENT DOCUMENTS

| | | | |
|---|---|---|---|
| Re. 27,966 | 4/1974 | Burst | 5/67 |
| 2,308,592 | 1/1943 | Drexler et al. | 5/66 |
| 2,630,720 | 3/1953 | Gambill | 74/722 |
| 3,216,026 | 11/1965 | Mann | 5/66 |
| 3,436,769 | 4/1969 | Burst | 5/67 |
| 3,821,821 | 7/1974 | Burst et al. | 5/68 |
| 4,097,940 | 7/1978 | Tekulve et al. | 5/66 |
| 5,095,562 | 3/1992 | Alexander | 5/616 |

*Primary Examiner*—Brian K. Green
*Assistant Examiner*—James M Hewitt
*Attorney, Agent, or Firm*—Bacon & Thomas, PLLC

[57] ABSTRACT

An adjustable supporting table generally comprises a basic frame, a first moveable bracket, a first pulley assembly, and a first driving device. The basic frame includes a main traverse rod. The first moveable bracket is pivotally attached to the basic frame and is provided with a traverse rod. The first pulley assembly is configured with a plurality of basic frame pulleys, a plurality of first pulleys, and a first cable. The basic pulley assembly is rotationally disposed at the main traverse rod of the basic frame. The first pulleys are rotationally disposed at a traverse rod of the first moveable bracket. The first cable is routed along those plurality of basic pulleys and first pulleys. The first driving device is fixedly disposed on the basic frame for extending or rewinding the first cable. Wherein when the first driving device is actuated, the first cable can be extended or wound such that the first moveable bracket can be disposed at a desired position.

3 Claims, 4 Drawing Sheets

ADJUSTABLE SUPPORTING TABLE

FIELD OF THE INVENTION

The present invention relates to a supporting table, more particularly, to an adjustable supporting table with which the cushion pad disposed thereon can be suitably positioned at a desired angular position by means of electromechanical devices.

DESCRIPTION OF PRIOR ART

Taiwan Patent Publication Nos. 116,466; 194,604; and 220,106 have disclosed an adjustable supporting table which can be positioned at different angular positions according to the requirements of the user. Those adjustable supporting tables are specially designed for clinical application.

SUMMARY OF THE INVENTION

It is the objective of this invention to provide an adjustable supporting table which provides an alternative for the customer.

According to one aspect of the present invention, the adjustable supporting table is driven and adjusted by means of electromechanical devices.

Still according to one aspect of the present invention, the angular adjustment of the supporting table can be conveniently facilitated by means of a set of push buttons or remote control through a set of electromechanical devices. Thus the angular adjustment of the supporting table can be simply and conveniently facilitated by the user. The inconvenience encountered by the conventional manual operation can be completely solved. The present invention features a simple and effective adjustable supporting table which can be readily manufactured at a lowered cost.

In order to achieve the objective set forth, the adjustable supporting table generally comprises a basic frame, a first moveable bracket, a first pulley assembly, and a first driving device. The basic frame includes a main traverse rod. The first moveable bracket is pivotally attached to the basic frame and is provided with a traverse rod. The first pulley assembly is configured by a plurality of basic frame pulleys, a plurality of first pulleys, and a first cable. The basic pulley assembly is rotationally disposed at the main traverse rod of the basic frame. The first pulleys are rotationally disposed at a traverse rod of the first moveable bracket. The first cable is routed along the basic pulleys and first pulleys. The first driving device is fixedly disposed on the basic frame for extending or rewinding the first cable.

When the first driving device is actuated to extend or rewind the first cable, the first moveable bracket can be suitably positioned at a desired angle or position. By this arrangement, when the first moveable bracket is pivotally lifted, it serves a firm support to the back of the user. Furthermore, the other end of the basic frame is further provided with a second moveable bracket, a second pulley assembly, and a second driving device. By this arrangement, the second moveable bracket can also be positioned at a suitable angular position. As a result, when the first and second moveable brackets are suitably positioned at suitable angular positions, the back and lower limbs of the user can be suitably supported.

The supporting table can be further disposed with a cushion pad to increase the comfort provided to the user. However, this is known to those skilled in the art and no detailed description is given.

The adjustable supporting table can also be placed directly onto the floor or a bed frame.

In order to provide a convenient operation by the user, the adjustable supporting table can also be remotely operated.

BRIEF DESCRIPTION OF DRAWINGS

In order that the present invention may be more readily understood the following description is given, merely by way of example, with reference to the accompanying drawings, in which.

DETAILED DESCRIPTION OF THE PREFERRED EMBODIMENT

Figure 1:
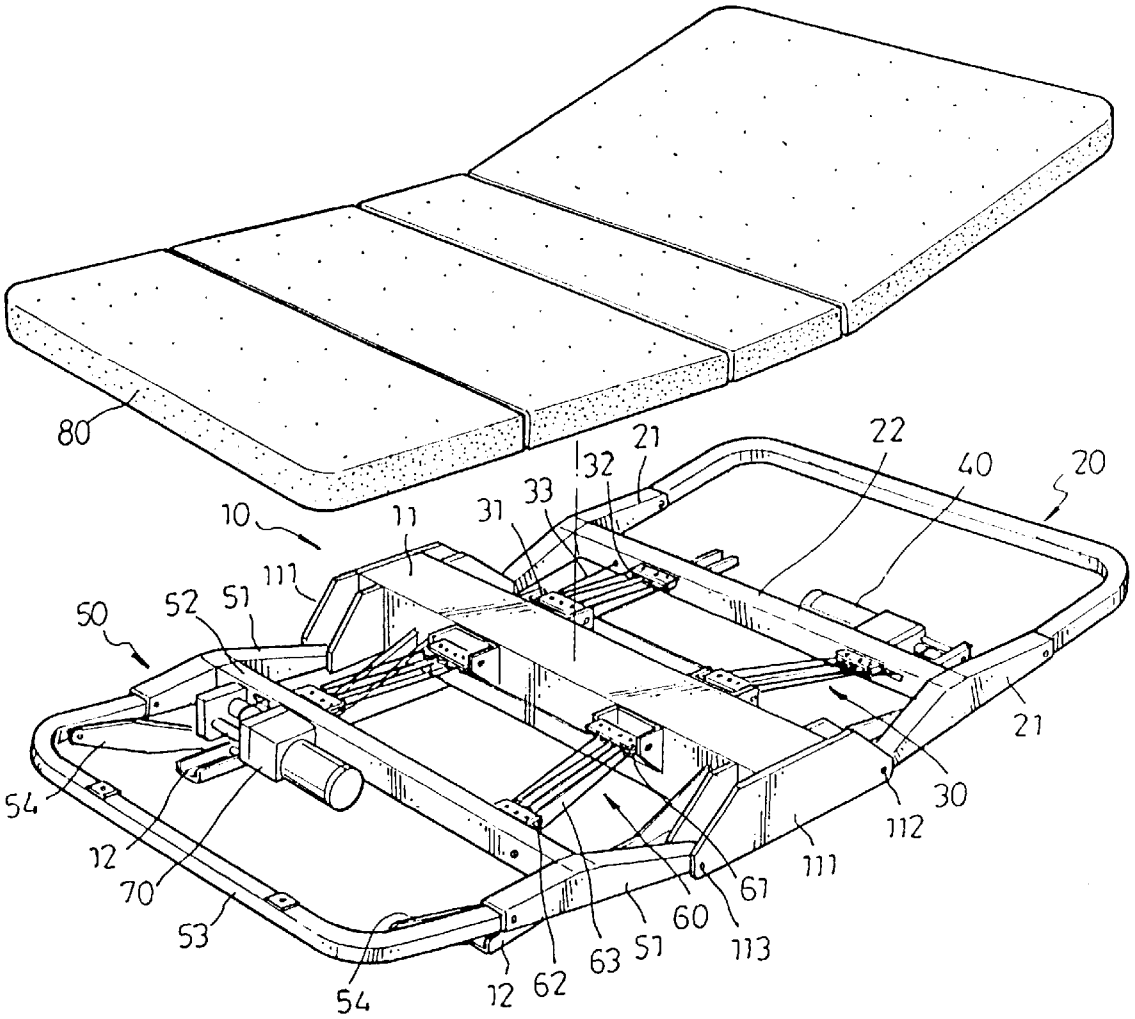
FIG. 1 is an exploded perspective view of the adjustable supporting table in which a pad can be removably disposed thereon.
Figure 2:
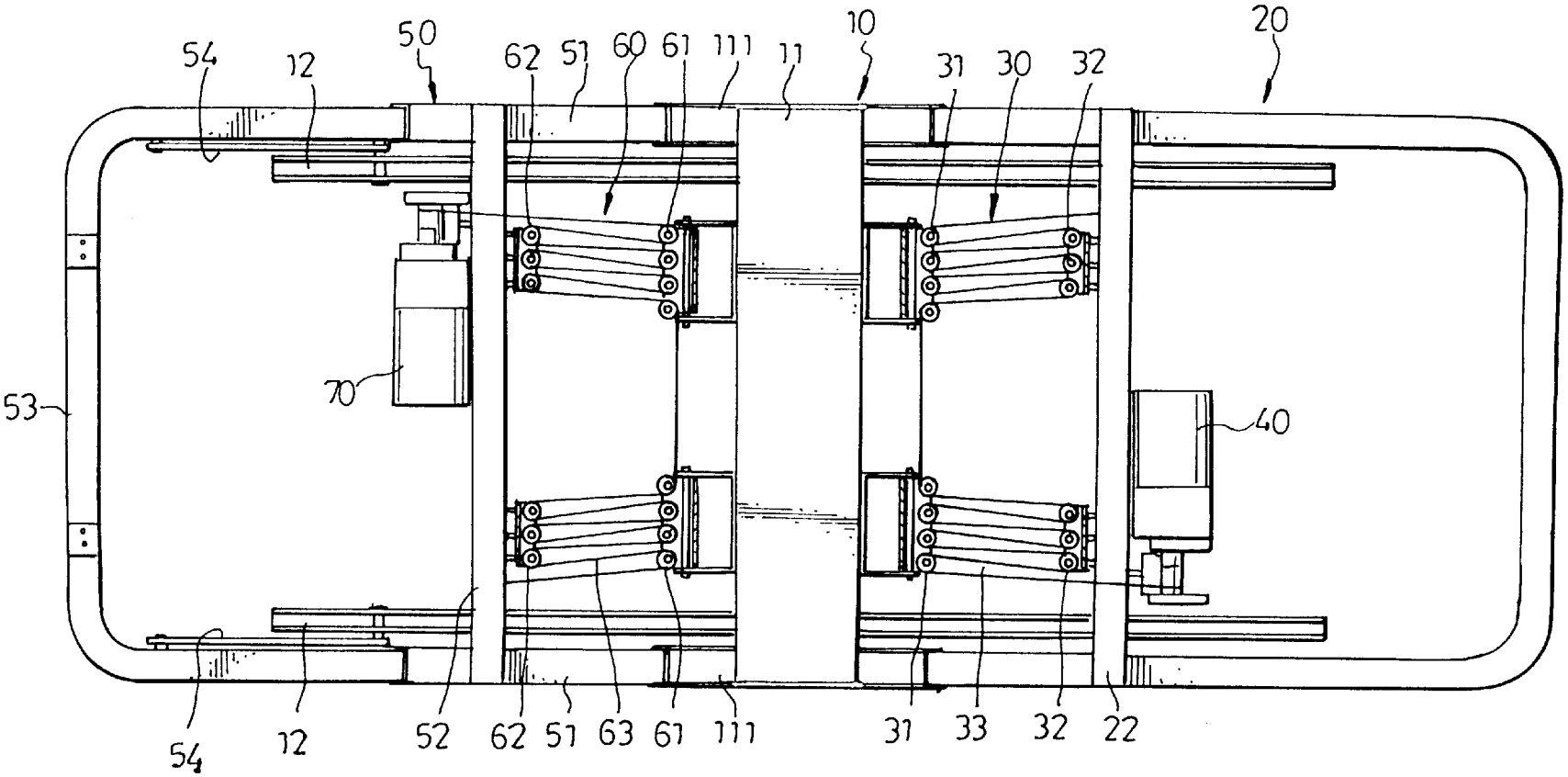
FIG. 2 is a top plan view of the adjustable supporting bracket.

Referring to FIGS. 1 and 2, the adjustable supporting table generally includes a basic frame 10, a first moveable bracket 20, a first pulley assembly 30, a first driving device 40, a second moveable bracket 50, a second pulley assembly 60, and a second driving device 70.

The basic frame 10 includes a main traverse rod 11 which is bridged between two bottom rods 12 which are spaced apart from each other. Each end of the main traverse rod 11 of the basic frame 10 is provided with a connecting arm 111. Each of the connecting arm 111 is provided with a front pivoting lug 112 and a rear pivoting lug 113.

The first moveable bracket 20 is provided with a connecting arm 21 at each of both sides respectively, and each connecting arm 21 is pivotally connected to a respective front pivoting lug 112 of a respective connecting arm 111 of the main traverse rod 11 of the basic frame 10.

The first pulley assembly 30 is configured by a plurality of first basic frame pulleys 31, a plurality of first pulleys 32, and a first cable 33. The basic pulley assembly 30 is rotationally disposed at the main traverse rod 11 of the basic frame 10. The first pulleys 32 are rotationally disposed at a first traverse rod 22 of the first moveable bracket 20. The first cable 32 is routed along those plurality of first basic pulleys 31 and first pulleys 32. As a result, a mechanical advantage can be attained by the provision of the pulley assembly 30. However, this is known to those skilled in the art and no detailed description will be given.

The first driving device 40 is fixedly disposed on the basic frame 10 for extending or rewinding the first cable 33. The first driving device 40 can be a controlled motor and it is also known to the skilled in the art and no detailed description is given.

The second moveable bracket 50 is also provided with a connecting arm 51 at each of both sides, respectively, and each arm 51 is pivotally connected to a respective rear pivoting lug 113 of a respective connecting arm 111 of the main traverse rod 11 of the basic frame 10.

The second pulley assembly 60 is configured by a plurality of second frame pulleys 61, a plurality of second pulleys 62, and a second cable 63. The basic pulley assembly

60 is rotationally disposed at the main traverse rod 11 of the basic frame 10. The second pulleys 62 are rotationally disposed at a second traverse rod 52 of the second moveable bracket 50. The second cable 63 is routed along those plurality of second basic pulleys 61 and second pulleys 62.

The second driving device 70 is fixedly disposed at the basic frame 10 for extending or rewinding the second cable 63.

A foldable pad 8 can be disposed on the adjustable supporting table.

Figure 3:
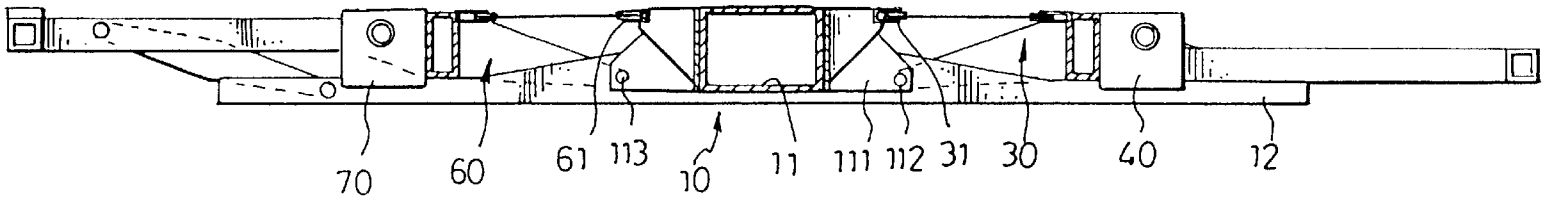
FIG. 3 is a side elevation view of the adjustable supporting table wherein the table is horizontally extended.
Figure 4:
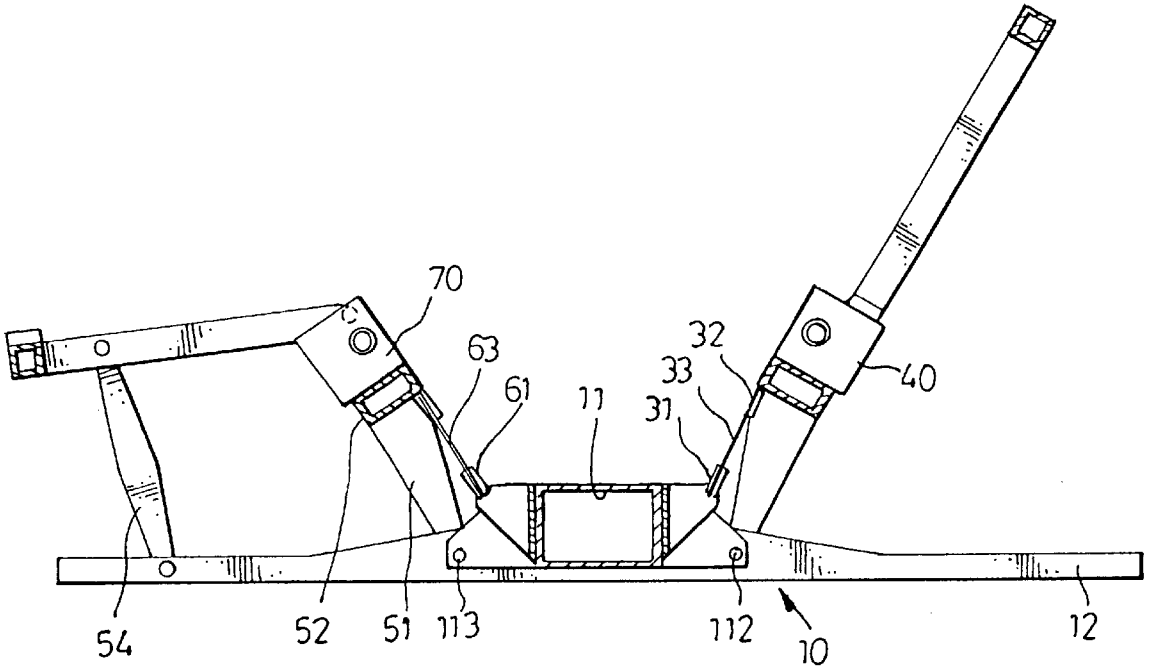
FIG. 4 is another a side elevation view of the supporting table wherein the brackets are angularly disposed relative to the base frame.

Referring to FIGS. 3 and 4, each end of the main traverse rod 11 of the basic frame 10 is provided with a connecting arm 111, respectively, and each of the connecting arms 111 is provided with a front pivoting lug 112 and a rear pivoting lug 113. The position of the front pivoting lug 112 is lower than the first basic frame pulleys 31 of the first pulley assembly 30. As a result, when the first cable 33 is extended or wound by the first driving device 40, the first moveable bracket 20 can be moved upward to an inclined position or disposed horizontally by the principle of lever. On the other hand, the rear pivoting lug 113 is lower than the second basic frame pulleys 61 of the second pulley assembly 60, as a result, by the actuation of the second driving device 70, the second cable 63 can be extended or wound such that the second moveable bracket 50 can be also moved upward to an inclined position or disposed horizontally by the principle of lever.

Figure 5:
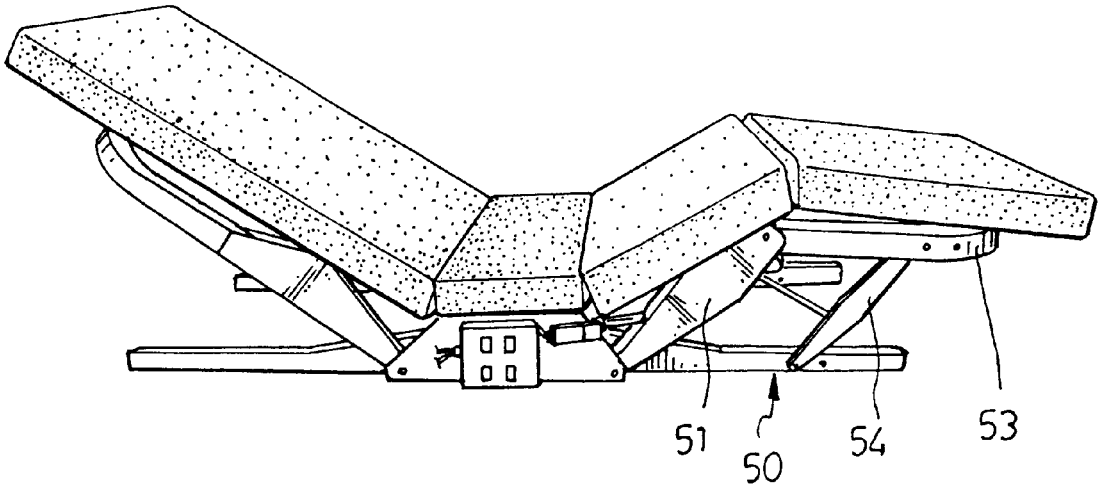
FIG. 5 is a schematic illustration showing the pad disposed on the supporting table which has already been adjusted to a certain position.

Referring to FIGS. 1 and 5, the second moveable bracket 50 is further provided with an extending bracket 53 and a pair of supporting arms 54. The extending bracket 53 is pivotally connected to the connecting arms 51 and supporting arms 54 can be used to position the extending bracket 53. The design of the second moveable bracket 50 is specially directed to provide a comfortable support for the thigh and the lower limbs. As a result, when the user lies on the pad which is supported by the adjustable supporting table, the lower limbs can be lifted higher to increase the comfort.

From the forgoing description, it can be readily appreciated that the invention features a simple, compact configuration which can be readily manufactured at lowered cost. While a particular embodiment of the present invention has been illustrated and described, it will be obvious to those skilled in the art that various other changes and modifications can be made without departing from the spirit and scope of the invention. It is therefore intended to cover in the appended claims all such changes and modifications that are within the scope of the present invention.

I claim:

1. An adjustable supporting table comprising:

a) a basic frame including a main traverse rod, the main traverse rod having a pair of main connecting arms, each main connecting arm including a front pivoting lug and a rear pivoting lug;

b) a first movable bracket pivotally attached to the basic frame and including a first traverse rod;

c) a first pulley assembly including a plurality of first basic frame pulleys, a plurality of first pulleys and a first cable, the first basic frame pulleys being rotatably disposed at the main traverse rod of the basic frame, the first pulleys being rotatably disposed at the first traverse rod of the first movable bracket, and the first cable being routed around and along the first basic frame pulleys and first pulleys, a level of the front pivoting lugs being lower than a level of the first basic frame pulleys of the first pulley assembly, the first movable bracket including a pair of sides, a first connecting arm at each side, and the first connecting arms being pivotally connected to the front pivoting lugs;

d) a first driving device for extending or rewinding the first cable;

e) a second movable bracket pivotally attached to the basic frame and including a second traverse rod;

f) a second pulley assembly including a plurality of second basic frame pulleys, a plurality of second pulleys and a second cable, the second basic frame pulleys being rotatably disposed at the main traverse rod of the basic frame, the second pulleys being rotatably disposed at the second traverse rod of the second movable bracket, the second cable being routed around and along the plurality of second basic frame pulleys and second pulleys, the level of the rear pivoting lugs being lower than a level of the second basic frame pulleys of the second pulley assembly, the second movable bracket including a pair of sides, a second connecting arm at each side, and the second connecting arms of the second movable bracket being pivotally connected to the rear pivoting lugs;

g) a second driving device for extending or rewinding the second cable;

h) the second movable bracket further including an extending bracket and a pair of supporting arms, the extending bracket being pivotally connected to the second connecting arms of the second movable bracket; and i) wherein when the first or second driving device is actuated, the corresponding first or second cables is extended or wound for respectively disposing the first or second movable bracket at a desired angular position with respect to the basic frame.

2. The adjustable supporting table of claim 1, wherein the main traverse rod of the basic frame further includes a pair of spaced bottom rods and the main traverse rod being bridged on the bottom rods.

3. The adjustable supporting table of claim 1, further including a cushion pad removably disposed on the basic frame and the first movable bracket.

* * * * *